US008100256B2

(12) United States Patent
Spivey, Sr. et al.

(10) Patent No.: US 8,100,256 B2
(45) **Date of Patent: *Jan. 24, 2012**

(54) REINFORCED CARTON WITH HANDLE

(75) Inventors: Raymond R. Spivey, Sr., Mableton, GA (US); Charles F. Ho Fung, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/840,390

(22) Filed: Jul. 21, 2010

(65) Prior Publication Data

US 2010/0282620 A1 Nov. 11, 2010

Related U.S. Application Data

(62) Division of application No. 12/031,167, filed on Feb. 14, 2008, now Pat. No. 7,793,779.

(60) Provisional application No. 60/889,789, filed on Feb. 14, 2007.

(51) Int. Cl.
*B65D 75/00* (2006.01)
*B65D 5/462* (2006.01)
*B66C 1/10* (2006.01)

(52) U.S. Cl. ... 206/153; 206/199; 206/427; 229/117.16; 294/87.2

(58) Field of Classification Search ..... 206/147, 206/151–158, 199, 427, 431, 432; 229/117.16, 229/117.18, 164.1; 294/87.2
See application file for complete search history.

(56) References Cited

U.S. PATENT DOCUMENTS

| | | | | |
|---|---|---|---|---|
| 2,330,699 | A | 9/1943 | Flamm | |
| 2,584,787 | A * | 2/1952 | Castle | 206/199 |
| 2,611,527 | A | 9/1952 | Fisher | |
| 3,144,130 | A | 8/1964 | Copping | |
| 3,166,190 | A * | 1/1965 | Conrades | 206/152 |
| 3,425,544 | A | 2/1969 | Ayer et al. | |
| 3,747,750 | A | 7/1973 | Chapman | |
| 3,897,873 | A | 8/1975 | Graser | |

(Continued)

FOREIGN PATENT DOCUMENTS

DE 2 159 258 6/1973

(Continued)

OTHER PUBLICATIONS

Preliminary Amendment dated Feb. 12, 2009, for U.S. Appl. No. 12/031,167.

(Continued)

*Primary Examiner* — Bryon Gehman
(74) *Attorney, Agent, or Firm* — Womble Carlyle Sandridge & Rice, LLP

(57) ABSTRACT

A carton for cooperating with a packaging material to contain a plurality of articles and a package formed thereby. The carton comprises a plurality of panels comprising a central panel, a first side panel, and a second side panel. The side panels are positioned relative to the central panel to at least partially form a space for receiving the articles. A handle is in at least one of the side panels. The handle is adapted for grasping and carrying the carton. A reinforcement flap is foldably attached to the at least one of the side panels. The reinforcement flap has at least one opening for receiving an article. A handle reinforcement flap is foldably attached to the at least one of the side panels.

24 Claims, 13 Drawing Sheets

U.S. PATENT DOCUMENTS

| | | | |
|---|---|---|---|
| 4,029,207 | A | 6/1977 | Gordon |
| 4,747,486 | A | 5/1988 | Benno |
| 4,754,879 | A | 7/1988 | Benno |
| 5,201,412 | A | 4/1993 | Schuster et al. |
| 5,445,262 | A | 8/1995 | Sutherland |
| 5,775,503 | A | 7/1998 | LeBras |
| 5,813,540 | A | 9/1998 | Vollbrecht et al. |
| 7,793,779 | B2 | 9/2010 | Spivey, Sr. et al. |

FOREIGN PATENT DOCUMENTS

| | | |
|---|---|---|
| FR | 2.041.931 | 2/1971 |

OTHER PUBLICATIONS

Office Action dated Sep. 15, 2009, for U.S. Appl. No. 12/031,167.
Response to Election of Species Requirement dated Oct. 14, 2009, for U.S. Appl. No. 12/031,167.
Office Action dated Dec. 23, 2009, for U.S. Appl. No. 12/031,167.
Amendment A and Response to Office Action dated Mar. 23, 2010, for U.S. Appl. No. 12/031,167.
Notice of Allowance and Fee(2) Due dated Jun. 2, 2010, for U.S. Appl. No. 12/031,167.
Supplemental Notice of Allowability dated Jul. 12, 2010, for U.S. Appl. No. 12/031,167.
Fee(s) Transmittal dated Aug. 12, 2010, for U.S. Appl. No. 12/031,167.
Issue Notification dated Aug. 25, 2010, for U.S. Appl. No. 12/031,167.
European Search Report dated Apr. 1, 2011 from related European patent application No. EP 10 01 3676.

* cited by examiner

REINFORCED CARTON WITH HANDLE

CROSS-REFERENCE TO RELATED APPLICATION

This application is a divisional of U.S. patent application Ser. No. 12/031,167, filed Feb. 14, 2008, now U.S. Pat. No. 7,793,779 which application claims the benefit of U.S. Provisional Application No. 60/889,789, which was filed on Feb. 14, 2007.

INCORPORATION BY REFERENCE

The entire contents of U.S. patent application Ser. No. 12/031,167, filed Feb. 14, 2008, and U.S. Patent Application No. 60/889,789, filed Feb. 14, 2007, are hereby incorporated by reference as if presented herein in their entirety.

BACKGROUND OF THE DISCLOSURE

The present disclosure generally relates to packages or cartons for holding and displaying containers. More specifically, the disclosure is directed to a carton having one or more handles for grasping and carrying the carton.

SUMMARY OF THE DISCLOSURE

In general, one aspect of the disclosure is generally directed to a carton for holding a plurality of containers. The carton comprises panels that extend at least partially around an interior of the package. The panels comprise at least one side panel having a handle for grasping and carrying the package.

In another aspect, the disclosure is generally directed to a carton for cooperating with a packaging material to contain a plurality of articles. The carton comprises a plurality of panels comprising a central panel, a first side panel, and a second side panel. The side panels being positioned relative to the central panel to at least partially form a space for receiving the articles. A handle is in at least one of the side panels and is adapted for grasping and carrying the carton. A reinforcement flap is foldably attached to the at least one of the side panels for positioning relative to the at least one of the side panels for contacting the articles to secure the carton to the articles.

In another aspect, the disclosure is generally directed to a package. The package generally comprises a carton comprising a central panel, a first side panel, a second side panel, a handle in at least one of the side panels, and a reinforcement flap foldably attached to the at least one of the side panels for positioning relative to the at least one of the side panels. The handle is adapted for grasping and carrying of the package and the side panels are positioned relative to the central panel to form a space. A plurality of articles are at least partially positioned in the space and contained in the carton. A packaging material is applied to the carton and the articles to attach the carton to the articles.

In other aspect, the disclosure is generally directed to a blank for forming a carton for containing a plurality of articles in cooperation with a packaging material. The blank generally comprises a plurality of panels comprising a central panel, a first side panel, and a second side panel. The side panels are for being positioned relative to the central panel to at least partially form a space for receiving the articles when the carton is formed from the blank. Handle features are in at least one of the side panels. The handle features comprise a handle adapted for grasping and carrying the carton formed from the blank. A reinforcement flap is foldably attached to the at least one of the side panels for positioning relative to the at least one of the side panels and for contacting the articles to secure the carton to the articles when the carton is formed from the blank.

In another aspect, the disclosure is generally directed to a method of forming a package. The method comprises providing a carton comprising a central panel, a first side panel, a second side panel, and a handle in at least one of the side panels. The handle is adapted for grasping and carrying of the package. The method further comprises positioning a plurality of articles relative to the carton and positioning the carton relative to the articles so that the plurality of articles are at least partially contained in the carton. The method further comprises applying a packaging material to the carton and the articles to at least partially attach the carton to the plurality of articles.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to constructs, sleeves, cartons, or the like, and packages for containing, holding, and displaying articles such as beverage containers (e.g., bottles, cans, jars, etc.). The articles can be used for packaging food and beverage products, for example. The articles can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Packages or cartons shown in the present disclosure can accommodate containers of numerous different shapes. For the purpose of illustration and not for the purpose of limiting the scope of the invention, the following detailed description describes beverage containers (e.g., plastic containers) at least partially disposed within the carton embodiments. In this specification, the terms "lower," "bottom," "upper" and "top" indicate orientations determined in relation to fully erected cartons.

Figure 1:
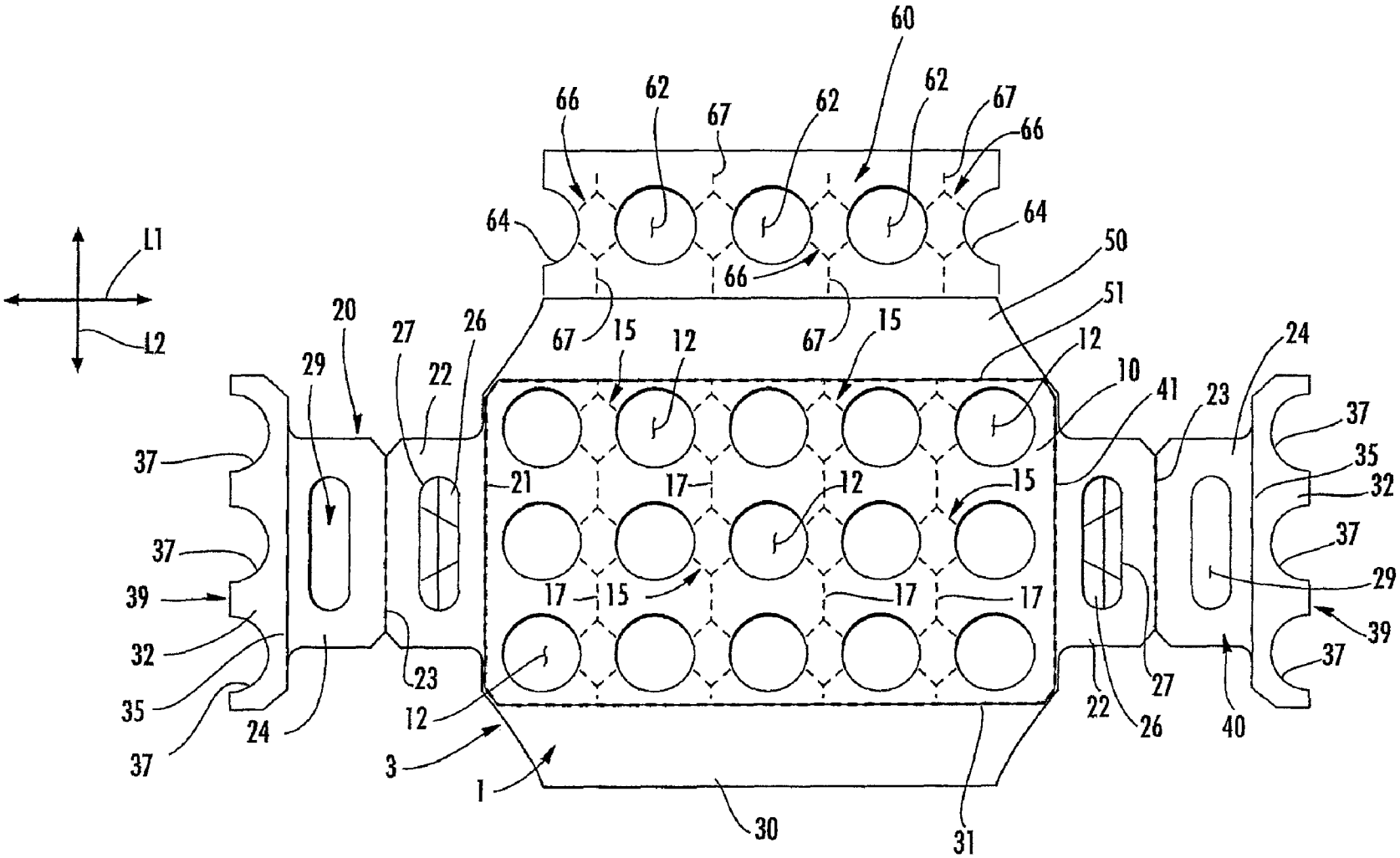
FIGS. 1-3 are various views of a blank and/or a carton of a first embodiment of the disclosure.
Figure 2:
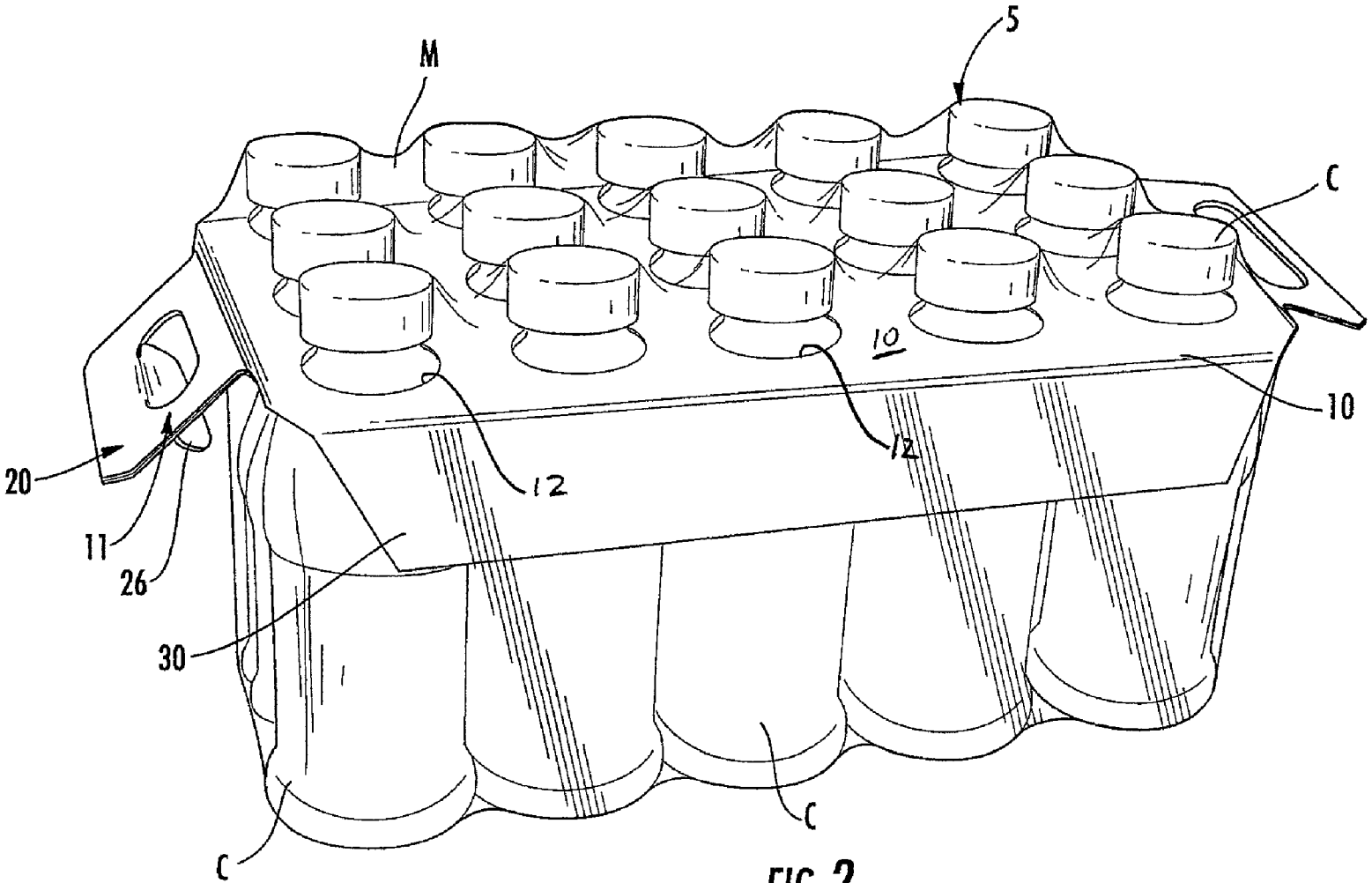

FIG. 1 is a plan view of a blank, generally indicated at 3, used to form a construct (e.g., a sleeve or a partial sleeve) that is referred to as a carton 5 (FIG. 2) according to a first embodiment. The carton 5 can be used to hold or contain a plurality of articles such as containers C (FIG. 2). The carton 5 and the containers C may be secured together by an overwrap of shrink-wrap (e.g., shrinkable polymer film) or other packaging material M (FIG. 2) so that the carton 5, containers C, and packaging material form a package 6. The carton 5 holds the containers and provides increased rigidity to the package 6 and stabilizes the containers C so that the package may be more easily handled.

Figure 3:
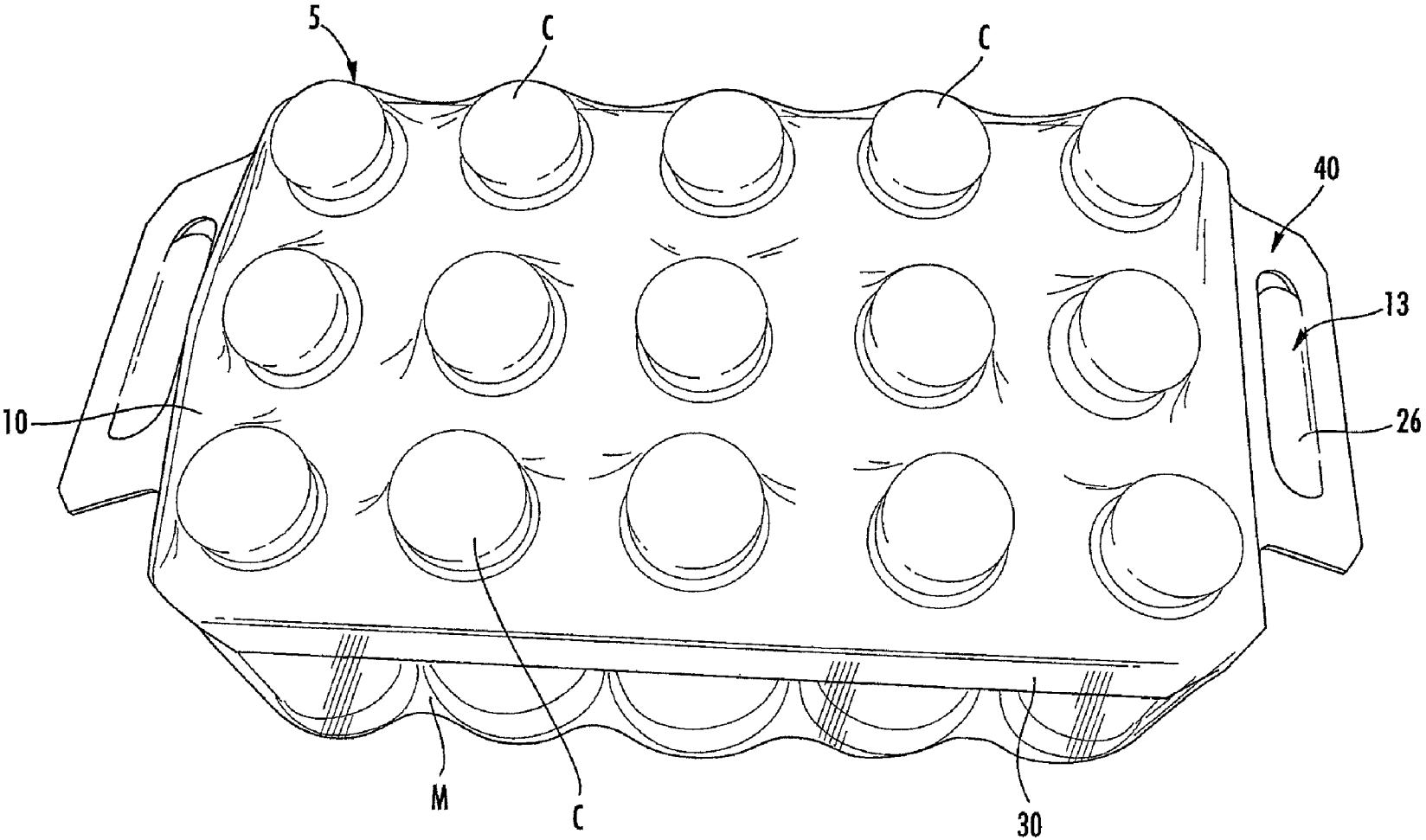

In the illustrated embodiments, the containers C are bottles containing a soft drink or other beverage but the containers may contain other beverage or food products. In the illustrated embodiments (e.g., embodiment of FIGS. 1-3), the carton 5 is sized to house fifteen containers C in a single layer in a 3×5 arrangement, but the carton 5 may be sized and shaped to hold containers of a different or same quantity in more than one layer and/or in different row/column arrangements (e.g., 1×6, 3×6, 2×6×2, 3×4×2, 2×9, 2×6, 3×4, etc.). In the embodiment of FIGS. 1-3, the carton 5 includes a first and a second handle, generally indicated at 11, 13, for grasping and carrying the carton. As will be discussed below in more detail, the handles 11, 13 are formed from various features in the blank 3.

The blank 3 has a longitudinal axis L1 and a lateral axis L2. In the illustrated embodiment, the blank 3 comprises a central panel 10 foldably connected to a first side panel 20 at a first lateral fold line 21, a front panel 30 foldably connected to the central panel 10 at a first longitudinal fold line 31, a second side panel 40 foldably connected to the central panel 10 at a second lateral fold line 41, and a back panel 50 foldably connected to the central panel 10 at a second longitudinal fold line 51.

In the embodiment of FIGS. 1-3, the central panel includes fifteen openings 12 arranged in a 3×5 pattern to correspond with the location of the containers C. Oblique fold lines 15 are arranged in the shape of a diamond between adjacent openings 12 in the three rows. Lateral fold lines 17 respectively connect the diamond-shaped fold lines 15 of adjacent rows. The oblique fold lines 15 and lateral fold lines 17 allow the central panel 10 to flex when the carton 5 is placed over the top of the containers C. The central panel 10 could be free from fold lines or could have fold lines that are otherwise shaped and arranged without departing from the invention. Further, the central panel 10 may include tear lines or other features that form a dispenser for allowing removal of the containers C from the carton 5.

The first side panel 20 is located at a first longitudinal end of the central panel 10 and includes a first panel 22 foldably connected to the central panel 10 and a second panel 24 foldably connected to the first panel at a lateral fold line 23. The first panel 22 includes an elongate handle flap 26 foldably connected to the first panel 22 at a lateral fold line 27. As shown in FIG. 1, the handle flap 26 is obstructing a handle opening in the first panel 22, and the handle flap 26 can be pivoted to expose the handle opening that it obstructs. The second panel 24 has an elongate opening 29 shaped to correspond with the handle flap 26. A reinforcement flap 32 is foldably connected to the second panel 24 at a lateral fold line 35. The reinforcement flap 32 includes three semicircular notches 37 in a lateral edge 39 of the flap.

In the embodiment of FIGS. 1-3, the second side panel 40 is located at a second longitudinal end of the central panel 10 and is generally a mirror image of the first side panel 20. Accordingly, like reference numbers have been used to designate similar or identical components (e.g., panels, flaps, fold lines, openings, etc.) that comprise the first and second side panels 20, 40. The first and second side panels 20, 40 may be otherwise shaped and/or arranged without departing from the invention.

In the embodiment of FIGS. 1-3, a reinforcement insert 60 is shown adjacent to the back panel 50. The reinforcement insert 60 is separate from the blank 3 and is used for overlaying at least a portion of the inner surface of the central panel 10 to reinforce the carton 5. The reinforcement insert 60 includes three circular openings 62 and two semicircular notches 64 at respective longitudinal ends of the reinforcement insert. The reinforcement insert 60 includes oblique fold lines 66 arranged to form diamond-shaped patterns between adjacent notches 64 and openings 62 in the insert. Lateral fold lines 67 extend from respective points of the diamond-shaped fold lines 66.

In the embodiment of FIGS. 1-3, the first handle 11 is formed in the first side panel 20 and the second handle 13 is formed in the second side panel 40 and has identical components as the first handle. As shown in FIG. 1, the features that form the first and second handles 11, 13 of the carton 5 include the elongate handle flaps 26 formed in the first panels 22 and the openings 29 formed in the second panels 24. The handles 11, 13 may include other features or the illustrated features may be otherwise shaped and/or arranged without departing from the invention.

The blank 3 is formed into the carton 5 by folding the second panels 24 of the side panels 20, 40 at lateral fold lines 23 so that respective second panels underlay the first panels 22 and respective reinforcement flaps 32 underlay a portion of the central panel 10. In the assembled position of the carton 5, the second panels 24 are in face-to-face contact with a respective one of the first panels 22, and the reinforcement flaps 32 are in respective face-to-face contact with a portion of the inner surface of the central panel 10. The side panels 20, 40 are downwardly folded relative to the central panel 10 to form a space for receiving containers C. The elongate handle openings 29 are aligned with the elongate handle flaps 26 and the notches 37 of each reinforcement flap 32 are aligned with respective openings 12 of the end columns of the openings. The reinforcement flaps 32 can be secured to the underside of the central panel 10 by adhesive (e.g., glue) placed on respective reinforcement flaps. The front panel 30 is folded downward at fold line 31 and the back panel 50 is folded downward at fold line 51.

The reinforcement panel 60 can be adhesively attached to a portion of the underside of the central panel 10. In one embodiment, the reinforcement panel 60 is positioned in the center of the central panel 10 so that the three openings 62 are aligned with the three middle openings 12 in the middle row of the openings in the central panel. In the illustrated embodiment, the two end notches 64 of the reinforcement panel 60 respectively cooperate with the middle notches 37 of the reinforcement flaps 32 to create a circular opening aligned with the two end openings 12 in the middle row of the openings in the central panel 10. The reinforcement panel 60 and reinforcement flaps 32 cooperate to add stiffness to the carton 5 so that the central panel 10 does not rip or tear when the carton is carried by the handles 11, 13. The reinforcement panel 60 could be otherwise shaped, arranged, positioned, and/or configured, or the reinforcement panel could be omitted, without departing from the invention.

As shown in FIGS. 2 and 3 the assembled carton 5 is placed over the top of the containers C so that portions of the containers (e.g., upper portions, which include caps) protrude through the openings 12 in the central panel 10. The containers C and the carton 5 are secured together by an overwrap of flexible polymer film (e.g., shrink-wrap) or other packaging material M with the handles 11, 13 protruding outward from the packaging material at respective sides of the carton. The handle panels 26 of the handles 11, 13 may be folded inward so that the carton 5 may be grasped and carried at the handles. The fold lines 15, 17 of the central panel 10 allow the central panels to flex and conform to the shape of the containers C when the carton 5 is pressed against the top of the containers by the tight wrapping of the packaging material M. One or more strips of flexible packaging material M is typically wrapped completely around the longitudinal axis of the carton 5 and adhered to itself so that it forms an enclosure with open opposite ends. Alternatively, one or more strips of packaging material M can be wrapped completely around the lateral axis of the carton 5 and adhered to itself and can cooperate with the packaging material wrapped around the longitudinal axis to form the enclosure.

The carton 5 is particularly useful in providing space for printing of graphics such as advertising or other information to be displayed for the consumer. For example, the front panel 30, back panel 50, central panel 10 and first and second side panels 20, 40 may have graphics printed on the respective exterior surfaces of the panels to convey information to the consumer. In the embodiment of FIG. 1, the central panel 10 is a top panel that fits over the top of the containers C, but the central panel may be otherwise configured so as to fit over the bottom of the containers without departing from the invention. Typically, the packaging material M is transparent so that advertising displayed on any of the panels (e.g., front panel 30, back panel 50, central panel 10, and/or side panels 20,40) is visible after the packaging material is applied to the carton 5.

Also, the reinforcement insert 60 and/or reinforcement flaps 32 may be otherwise shaped and/or arranged or may be omitted without departing from the invention. The reinforcement insert 60 may be foldably attached to any of the various panels or flaps without departing from the invention. Also, the reinforcement insert 60 may be otherwise located on the interior surface or exterior surface of the central panel 10 without departing from the invention.

Figure 4:
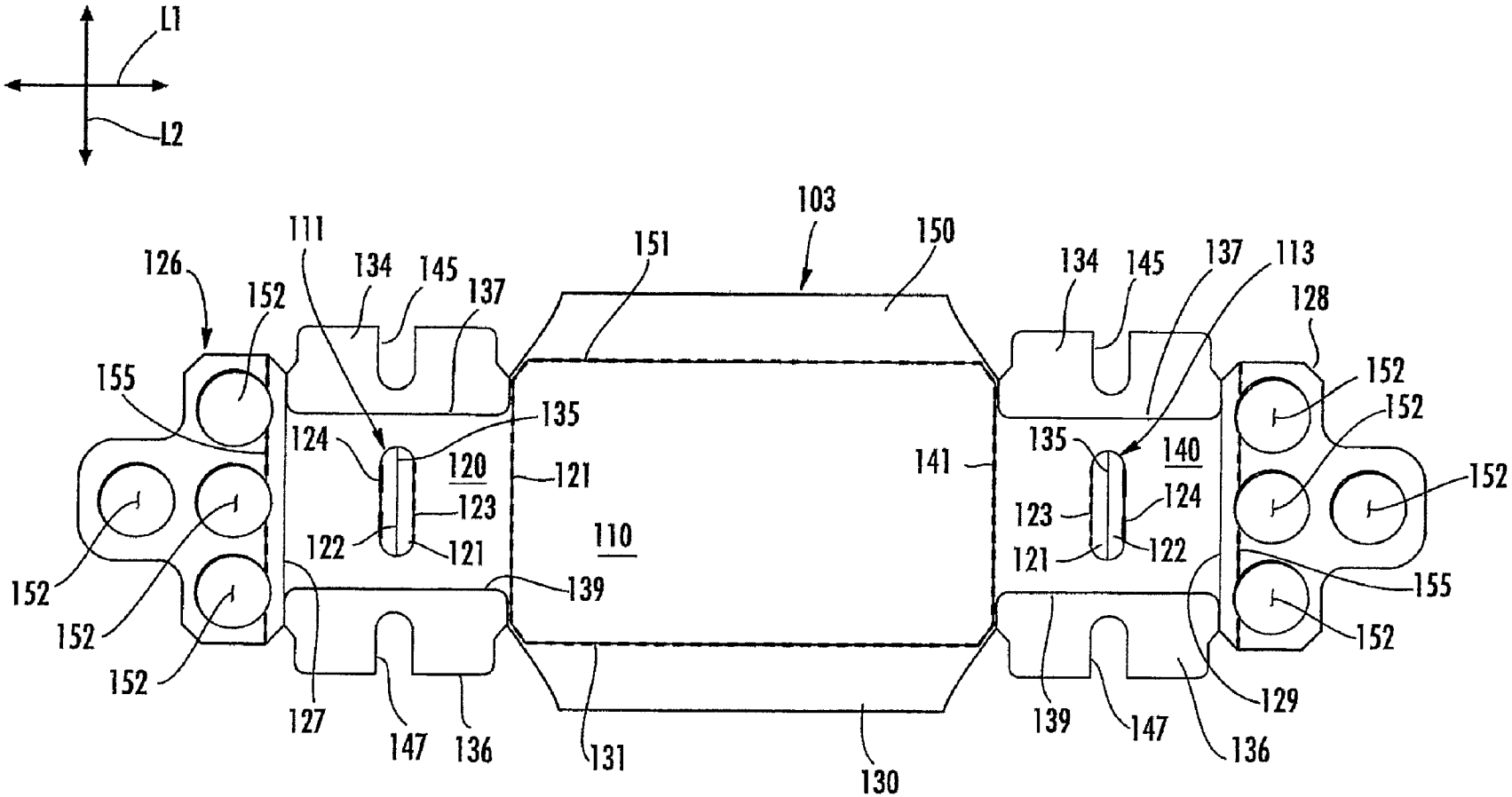
FIGS. 4-6 are various views of a blank and/or carton of a second embodiment of the disclosure.

FIG. 4 shows a second embodiment of a blank 103 used to form a carton 105 (FIGS. 5-6) that may be secured to containers C by packaging material M. The second embodiment is generally like the first embodiment, except for variations noted and variations that will be apparent to one of ordinary skill in the art. The carton 105 includes a first and second handle 111, 113 in respective sides of the carton. The blank 103 includes a central panel 110 foldably connected to a first side panel 120 at a first lateral fold line 121. A second side panel 140 is foldably connected to the central panel 110 at a second lateral fold line 141. A first top panel 126 is foldably connected to the first side panel 120 at a third lateral fold line 127, and a second top panel 128 is foldably connected to the second side panel 140 at a fourth lateral fold line 129. A front panel 130 is foldably connected to the central panel 110 at a first longitudinal fold line 131 and a back panel 150 is foldably connected to the central panel at a second longitudinal fold line 151.

The first side panel 120 has opposed elongate handle flaps 121, 122 that together obstruct a handle opening in the first side panel 120 and are respectively foldably connected to the first side panel at lateral fold lines 123, 124. The handle flaps 121, 122 are separated by a lateral tear or cut line 135 in the first side panel 120. A first handle reinforcement flap 134 is foldably attached to the first side panel 120 at a longitudinal fold line 137, and a second handle reinforcement flap 136 is foldably attached to the first side panel at a longitudinal fold line 139. Each handle reinforcement flap 134, 136 has a respective notch 145, 147 or opening for overlaying at least a portion of the handle flaps 121, 122.

Figure 5:
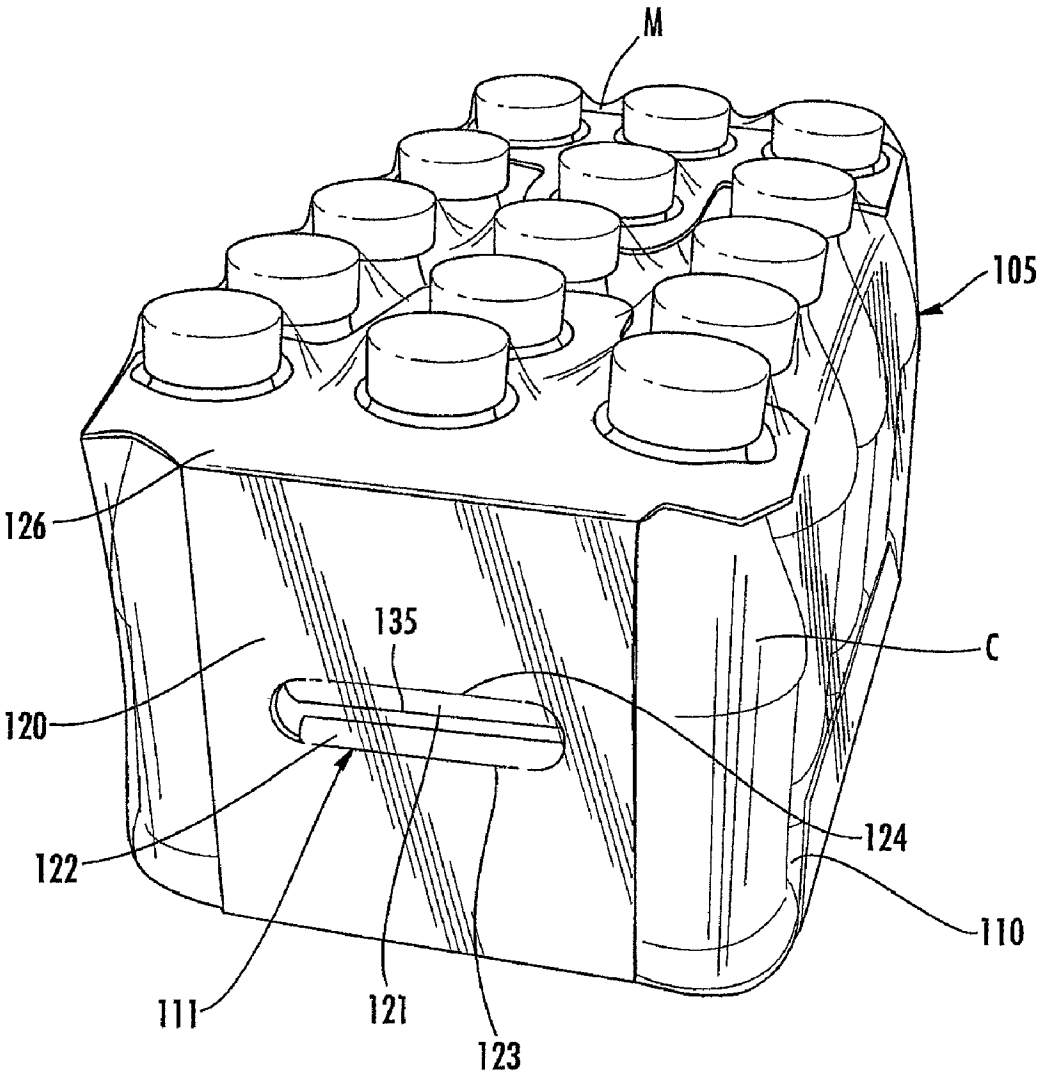
Figure 6:
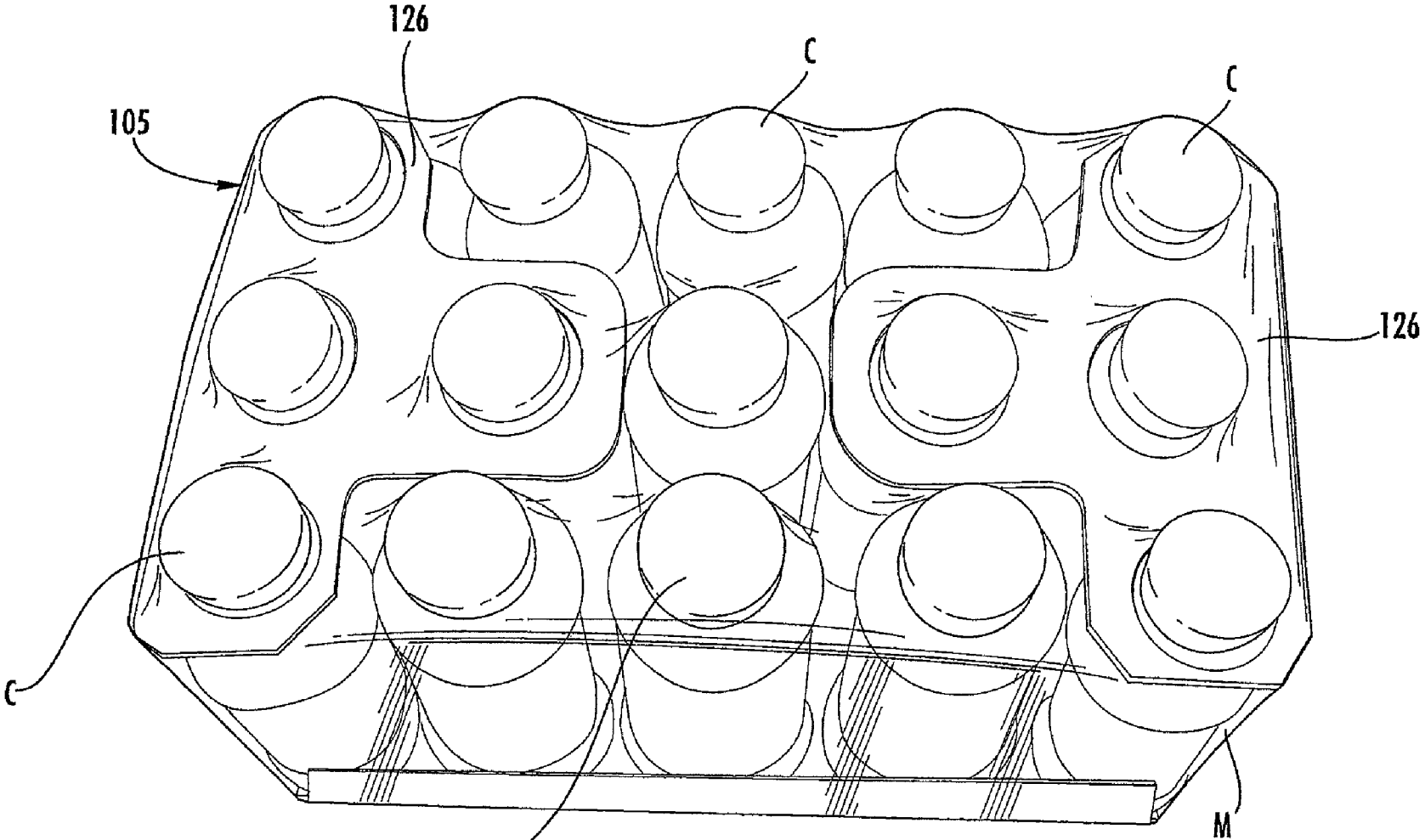

In the embodiment of FIGS. 4-6, the second side panel 140 is generally a mirror image of the first side panel 120. Accordingly, like reference numbers have been used to designate similar or identical components (e.g., panels, flaps, fold lines, openings, etc.) that comprise the first and the second side panels 120, 140. The first and second side panels 120, 140 may be otherwise shaped and/or arranged without departing from the invention.

The first top panel 126 includes four openings 152 arranged in two columns, with the first column adjacent to the first side panel 120 having three openings, and the second column including a single opening. The first top panel 126 has a lateral fold line 155 generally tangential to one side of the three circular openings 152 in the first column. The first top panel 126 could be otherwise shaped and arranged, and could, for example, include more than four openings 152 and the openings could be otherwise arranged without departing from the invention.

The second top panel 128 is generally a mirror image of the first top panel 126. Accordingly, like reference numbers have been used to designate similar components that comprise the first and the second top panels 126, 128. The first and/or second top panels 126, 128 may be otherwise shaped and/or arranged without departing from the invention.

In the embodiment of FIGS. 4-6, the first handle 111 is formed in the first side panel 120, and the second handle 113 is formed in the second side panel 140 and has identical components as the first handle. As shown in FIGS. 4 and 5, the features that form the first and second handles 111, 113 of the carton 105 include the elongate handle flaps 121, 122, lateral cut line 135, the handle reinforcement flaps 134, 136, notches 145, 147, and fold lines 123, 124. The handles 111, 113 may include other features and the illustrated features may be otherwise shaped and/or arranged without departing from the invention.

Containers C may be placed on the central panel 110 of the blank 103 prior to forming the carton 105 from the blank. Alternatively, the carton 105 can be formed from the blank 103 prior to positioning of the containers C. The bottoms of the containers C are placed on the central panel 110 so that the central panel forms the bottom of the carton 105. The blank 103 is formed into the carton 105 by respectively folding the handle reinforcement flaps 134, 136 at fold lines 137, 139 so that each of the handle reinforcement flaps is in face-to-face contact with the first side panel 120 and second side panel 140. The handle reinforcement flaps 134, 136 may be attached to the inner surface of the first and second side panels 120, 140 by adhesive (e.g., glue). The first and second side panels 120, 140 are respectively upwardly folded relative to the central panel 110 at fold lines 121, 142 so that the first and second side panels are generally perpendicular to the central panel 110. The first and second top panels 126, 128 are respectively folded at fold lines 127, 136 so that the top panels partially overlay the tops of the containers C. The central panel 110, upwardly folded side panels 120, 140, and first and second top panels 126, 128 form a space for receiving the containers C. In the embodiment, of FIGS. 4-6, the first and second top panels 126, 128 are retention flaps that are spaced-apart from the central panel 110 to form the space for receiving the containers. As shown in FIG. 6, the openings 152 in each of the top panels 126, 128 respectively fit four containers C including the three containers in each end column of containers and the middle container in each of the second columns respectively adjacent an end column of the containers. The first and second top panels 126, 128 are placed on tops of the containers so that the tops of the containers are at least partially received in the openings 152.

As shown in FIGS. 5-6, the containers C and the carton 105 are secured together by an overwrap of shrink-wrap or other packaging material M with the handles 111, 113 in the upwardly folded side panels 120, 140 remaining at least partially uncovered by packaging material at respective sides of the carton. The handle panels 121, 122 of the handles 111, 113 may be folded inward to activate the handles so that the carton 105 may be grasped and carried at the handles. Alternatively, the handles 111, 1113 may be initially covered by packaging material M and the packaging material can be punctured and pushed or folded inward through the handle openings when the handles are activated.

Figure 7:
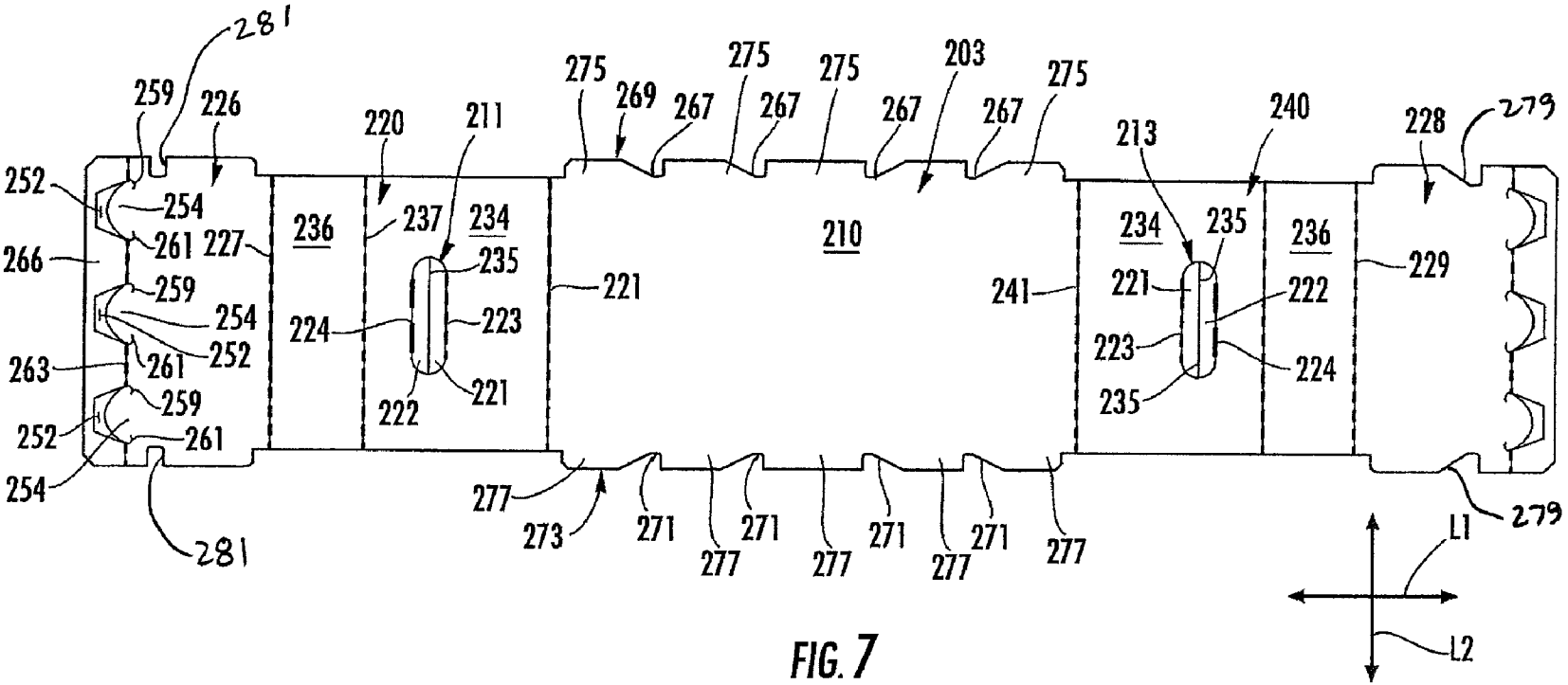
FIGS. 7-9 are various view of a blank and/or carton of a third embodiment of the disclosure.

FIG. 7 shows a third embodiment of a blank 203 used to form a carton 205 (FIGS. 8-9) that may be secured to containers C by packaging material M. The third embodiment is like the second embodiment, except for variations noted and variations that will be apparent to one of ordinary skill in the art. The carton 205 includes a first and a second handle 211, 213 in respective sides of the carton. The blank 203 includes a central panel 210 foldably connected to a first side panel 220 at a first lateral fold line 221. A second side panel 240 is foldably connected to the central panel 210 at a second lateral fold line 241. A first top panel 226 is foldably connected to the first side panel 220 at a third lateral fold line 227 and a second top panel 228 is foldably connected to the second side panel 240 at a fourth lateral fold line 229.

The first side panel 220 comprises a lower panel 234 foldably connected to the central panel 210 and an upper panel 236 foldably connected to the lower panel at a lateral fold line 237. The lower panel 234 comprises opposed elongate handle flaps 221, 222 respectively foldably connected to the first side panel at longitudinal fold lines 223, 224. The handle flaps 221, 222 are separated by a longitudinal cut line 235 in the lower panel 234.

Figure 8:
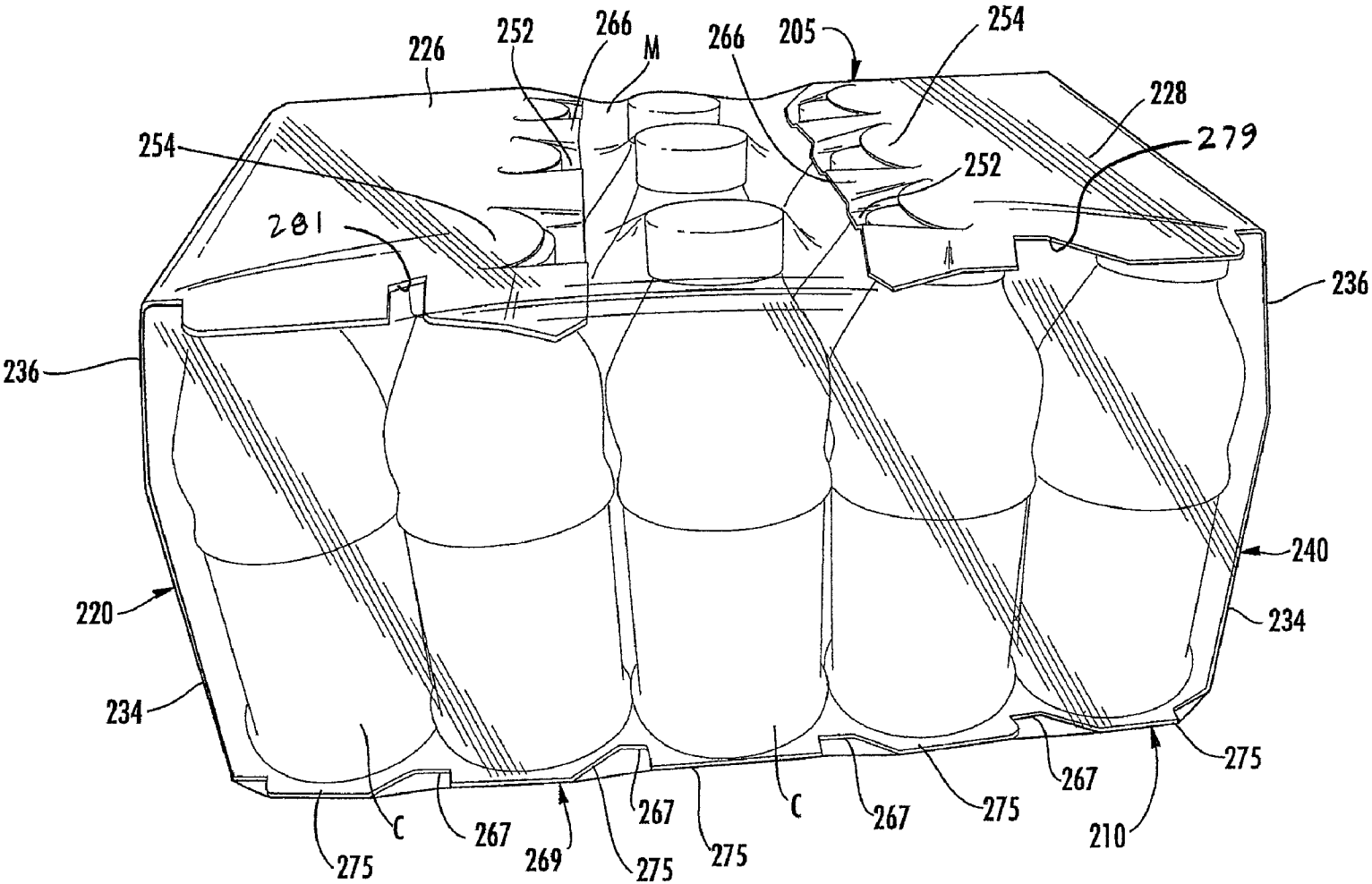
Figure 9:
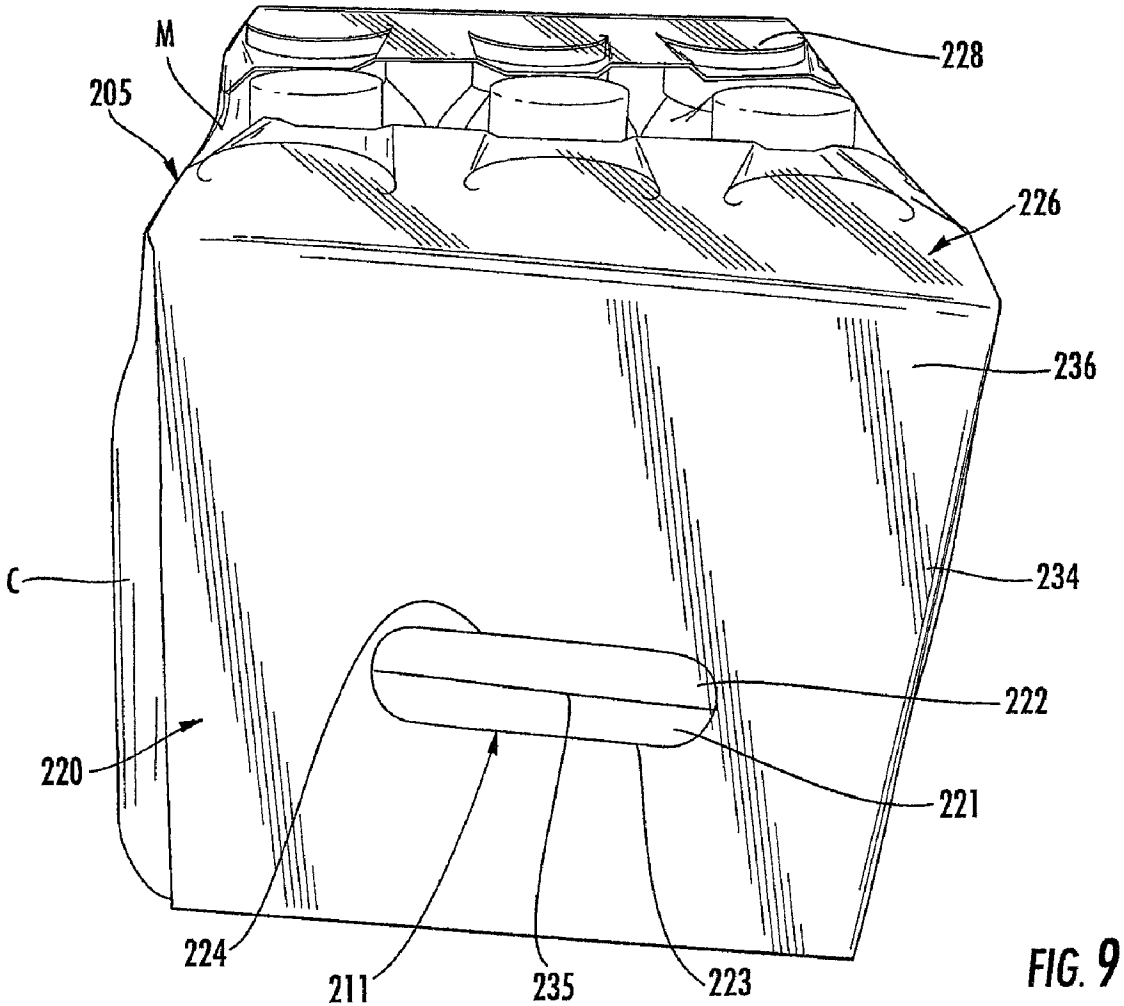

In the embodiment of FIGS. 7-9, the second side panel 240 is generally a mirror image of the first side panel 220. Accordingly, like reference numbers have been used to designate similar or identical components (e.g., panels, flaps, fold lines, openings, etc.) that comprise the first and the second side panels 220, 240. The first and second side panels 220, 240 may be otherwise shaped and/or arranged without departing from the invention.

The first top panel 226 includes locking features for engaging the top portions of the containers C. In the illustrated embodiment, the locking features comprise three openings 252 in the first top panel 226 that are adjacent to and form a respective flap 254 that is foldably connected to the top panel. The flaps 254 are generally semicircular-shaped and are each defined by upper and lower curved cuts 259, 261 in the top panel 226. The top panel 226 includes a lateral fold line 263 extending between the flaps 254 and to the longitudinal edges of the top panel. The lateral fold line 263 allows an edge margin 266 between the fold line and the lateral edge of the top panel 226 to flex and conform to the shape of the containers C (see FIG. 9). The flaps 254 are foldable relative to the top panel 226 to expand the openings 252 and allow the top of the containers C to at least partially protrude through the top panel. The flaps 254 engage the top potions of the containers C to lock the carton 205 on the containers. The first top panel 226 may have locking features that are otherwise shaped, arranged, and/or positioned, or the first top panel could be free from locking features without departing from the invention.

The second top panel 228 is generally a mirror image of the first top panel 226. Accordingly and in some cases, like reference numbers have been used to designate similar components that comprise the first and the second top panels 226, 228. The first and/or second top panels 226, 228 may be otherwise shaped and/or arranged without departing from the invention.

In the embodiment of FIGS. 7-9, the first handle 211 is formed in the first side panel 220 and the second handle 213 is formed in the second side panel 240 and has identical components as the first handle. As shown in FIG. 8, the features that form the first and second handles 211, 213 of the carton 2055 include the elongate handle flaps 221, 222, fold lines 223, 224, and cut lines 235. The handles may 211, 213 include other features and the illustrated features may be otherwise shaped and/or arranged without departing from the invention.

In the embodiment of FIGS. 7-9, the central panel 210 includes four generally v-shaped notches 267 in a first longitudinal edge 269 of the central panel and four generally v-shaped notches 271 in a second longitudinal edge 273 of the central panel. The notches 267, 271 form respective panels 275, 277 at the edges 269, 273 of the central panel. As shown in FIG. 9, the panels 275, 277 are for receiving and supporting a bottom portion of respective containers of the outer two rows of containers. The notches 267, 271 are positioned to generally correspond with the location where the containers of each adjacent column meet so that the edges 269, 273 of the central panel 210 have protruding portions (e.g., panels 275, 277) that generally conform to the shape of the rows of cylindrical containers. In the illustrated embodiment, the second top panel 228 includes generally v-shaped notches 279 in opposed longitudinal edges of the second top panel. The first top panel 226 includes generally u-shaped notches 281 in opposed longitudinal edges of the first top panel.

The containers C may be placed on the central panel 210 of the blank 203 prior to forming the carton 205 from the blank. The bottoms of the containers C are placed on the central panel 210 so that the central panel forms the bottom of the carton 205. The blank 203 is formed into the carton 205 by respectively folding the first and second side panels 220, 240 upwardly relative to the central panel 210 at fold lines 221, 241 so that the two lower side panels 234 are generally perpendicular to the central panel 210. The two upper panels 236 are folded relative the lower side panels 234 at fold lines 237 so that the upper panels are angled inward toward the interior of the carton 205. The first and second top panels 226, 228 are respectively folded at fold lines 227, 229 so that the top panels partially overlay the top of the containers C. In one embodiment, the top panels 226, 228 are spaced apart from the central panel 210 by the side panels 220, 240 to form a space for receiving the containers C. In this embodiment, the top panels 226, 228 function as the reinforcement flaps that assist in attaching the carton 205 to the containers C and enhance the structure integrity of the carton. As shown in FIG. 8, the flaps 254 in each of the top panels 226, 226 can be upwardly folded to expand the openings 252 so as to at least partially receive the tops of the containers C through the top panels. The edge margins 266 of the top panels 226, 228 may be downwardly folded to further secure the carton 5 to the containers C.

As shown in FIG. 9, the containers C and the carton 205 are further secured together by an overwrap of shrink-wrap or other packaging material M with the handles 211, 213 in the upwardly folded side panels 220, 240 typically remaining substantially uncovered by packaging material at respective sides of the carton. The handle panels 221, 222 of the handles 211, 213 may be folded inward so that the carton 105 may be grasped and carried at the handles. The packaging material M at least partially protrudes into the notches 267, 271, 279, and 281 to enhance attachment of the packaging material M to the carton 205. Additional features, including additional notches, may be provided to enhance the gripping of the packaging material M to the carton 205.

Figure 10:
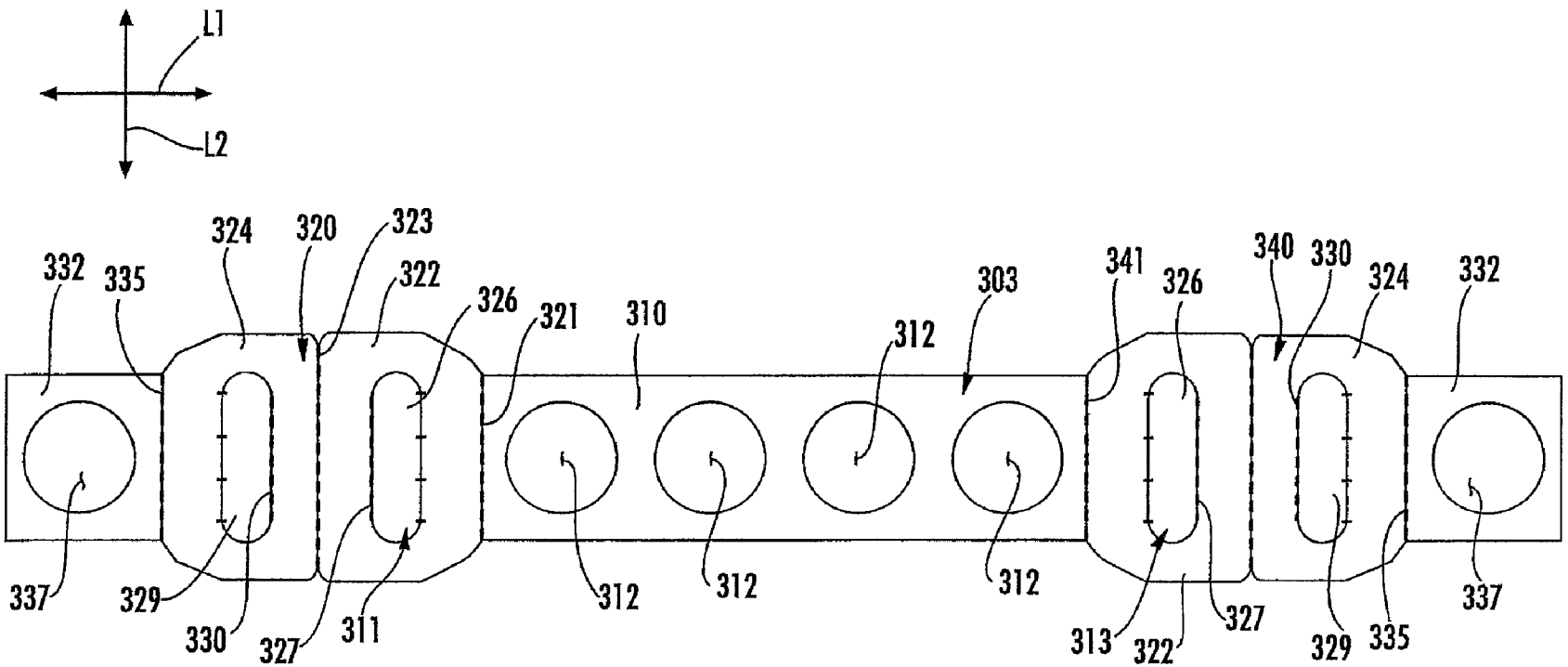
FIGS. 10-11 are various views of a blank and/or carton of a fourth embodiment of the disclosure.
Figure 11:
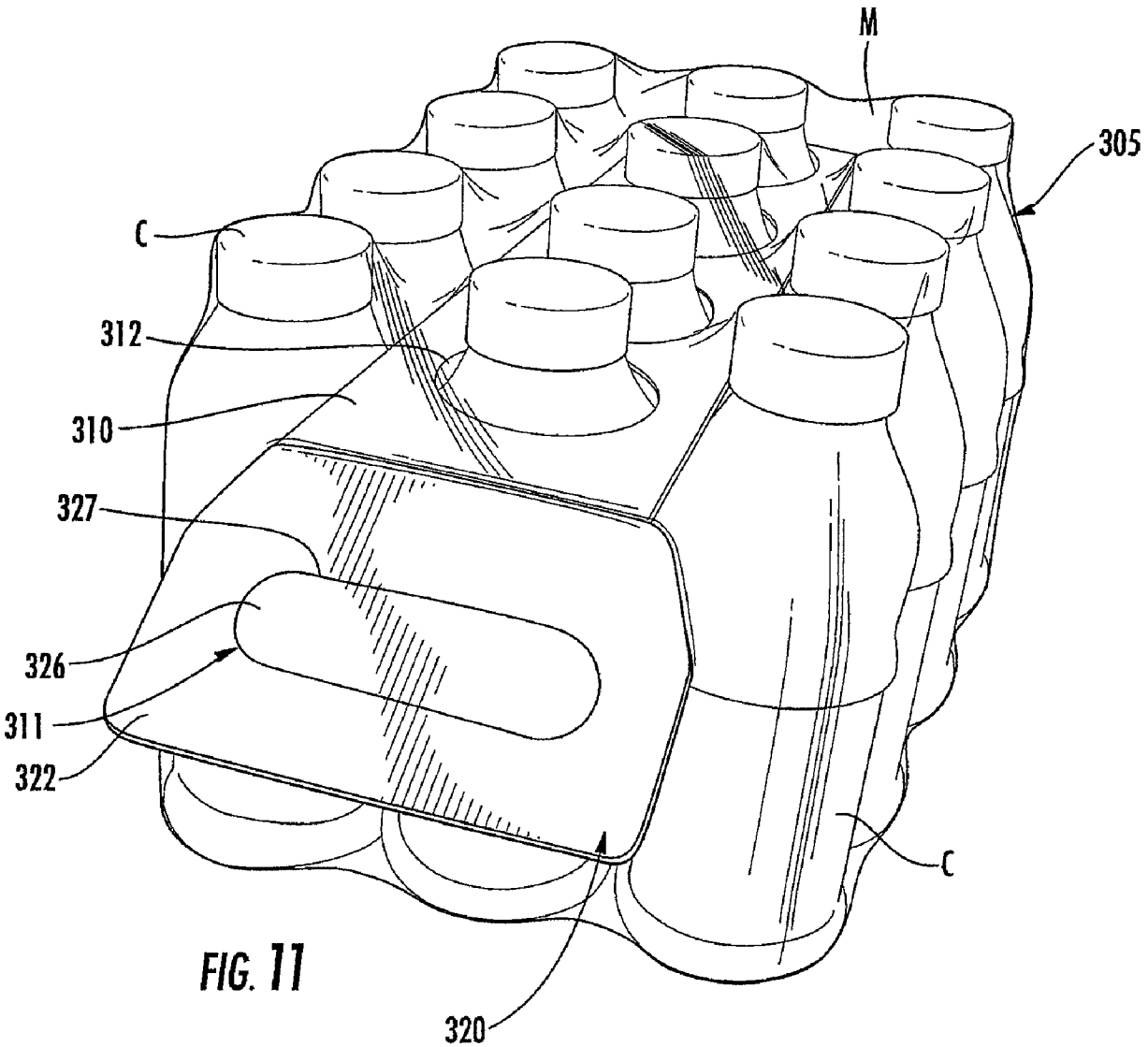

FIG. 10 shows a fourth embodiment of the blank 303 used to form a carton 305 (FIG. 11) that may be secured to containers C by packaging material M. The fourth embodiment is like the first embodiment, except for variations noted and variations that will be apparent to one of ordinary skill in the art. In the embodiment of FIG. 11, the carton 305 and packaging material M contain twelve containers C arranged in a 3×4 arrangement. In the embodiment of FIGS. 10-11, the blank 303 comprises a central panel 310 foldably connected to a first side panel 320 at a first lateral fold line 321 and a second side panel 340 foldably connected to the central panel 310 at a second lateral fold line 341.

In the embodiment of FIGS. 10-11, the central panel 310 includes four circular openings 312 in a single row that correspond with the location of the containers of the middle row of containers in the 3×4 arrangement. More or less than four openings 312 may be included in the central panel 310 without departing from the invention.

The first side panel 320 is located at a first longitudinal end of the central panel 310 and includes a first panel 322 foldably connected to the central panel 310 and a second panel 324 foldably connected to the first panel at a lateral fold line 323. The first panel 322 includes an elongate handle flap 326 foldably connected to the first panel 322 at a lateral fold line 327. The second panel 324 has an elongate handle flap 329 foldably connected to the second panel at a lateral fold line 330 and shaped to correspond with the handle flap 326. A reinforcement flap 332 is foldably attached to the second panel 324 at a lateral fold line 335. The reinforcement flap 332 includes a single circular opening 337 similar in size as the openings 312 in the central panel.

In the embodiment of FIGS. 10-11, the second side panel 340 is located at a second longitudinal end of the central panel 310 and is generally a mirror image of the first side panel 320. Accordingly, like reference numbers have been used to designate similar or identical components or features that comprise the first and second side panels 320, 340. The first and second side panels 320, 340 may be otherwise shaped and arranged without departing from the invention.

In the embodiment of FIGS. 10-11, the first handle 311 is formed in the first side panel 320 and the second handle 313 is formed in the second side panel 340 and has identical features and components as the first handle. As shown in FIG. 11, the features that form the first and second handles 311, 313 of the carton 305 include the elongate handle flaps 326 formed in the first panels 322 and the elongate handle flaps 329 formed in the second panels 324. In the assembled carton 305, the first and second panels 322, 324 are overlapped so that the handles 311, 313 are two-ply handles. The handles 311, 313 may include other features or the illustrated features may be otherwise shaped and/or arranged without departing from the invention.

The blank 303 is formed into the carton 305 by folding the second panels 324 of the side panels 320, 340 at lateral fold lines 323 so that respective second panels are in face-to-face contact with the bottom surface of the first panels 322. Respective reinforcement flaps 332 are in face-to-face contact with a portion of the central panel 310. The elongate handle flaps 329 in the second panels 324 are aligned with the elongate handle flaps 326 in the first panels 322. The openings 337 of each reinforcement flap 332 are aligned with respective openings 312 of central panel 310 that are respectively adjacent the first panels 322. The reinforcement flaps 332 can be secured to the underside of the central panel 310 by adhesive (e.g., glue).

As shown in FIG. 11 the assembled carton 305 is placed over the top of the containers C so that portions of the containers protruded through the openings 312 in the central panel 310. The side panels 320, 340 can be downwardly folded relative to the central panel 310 to form a space for receiving the containers. In one embodiment, the carton 305 is placed on the middle row of containers arranged in the 3×4 arrangement. The containers C and the carton 305 are secured together by an overwrap of shrink-wrap or other packaging material M with the handles 311, 313 protruding outward from the packaging material at respective sides of the carton. The handles 311, 313 can be activated by inwardly folding the overlapped handle panels 326, 329 so that the carton 305 may be grasped and carried at the handles.

Figure 12:
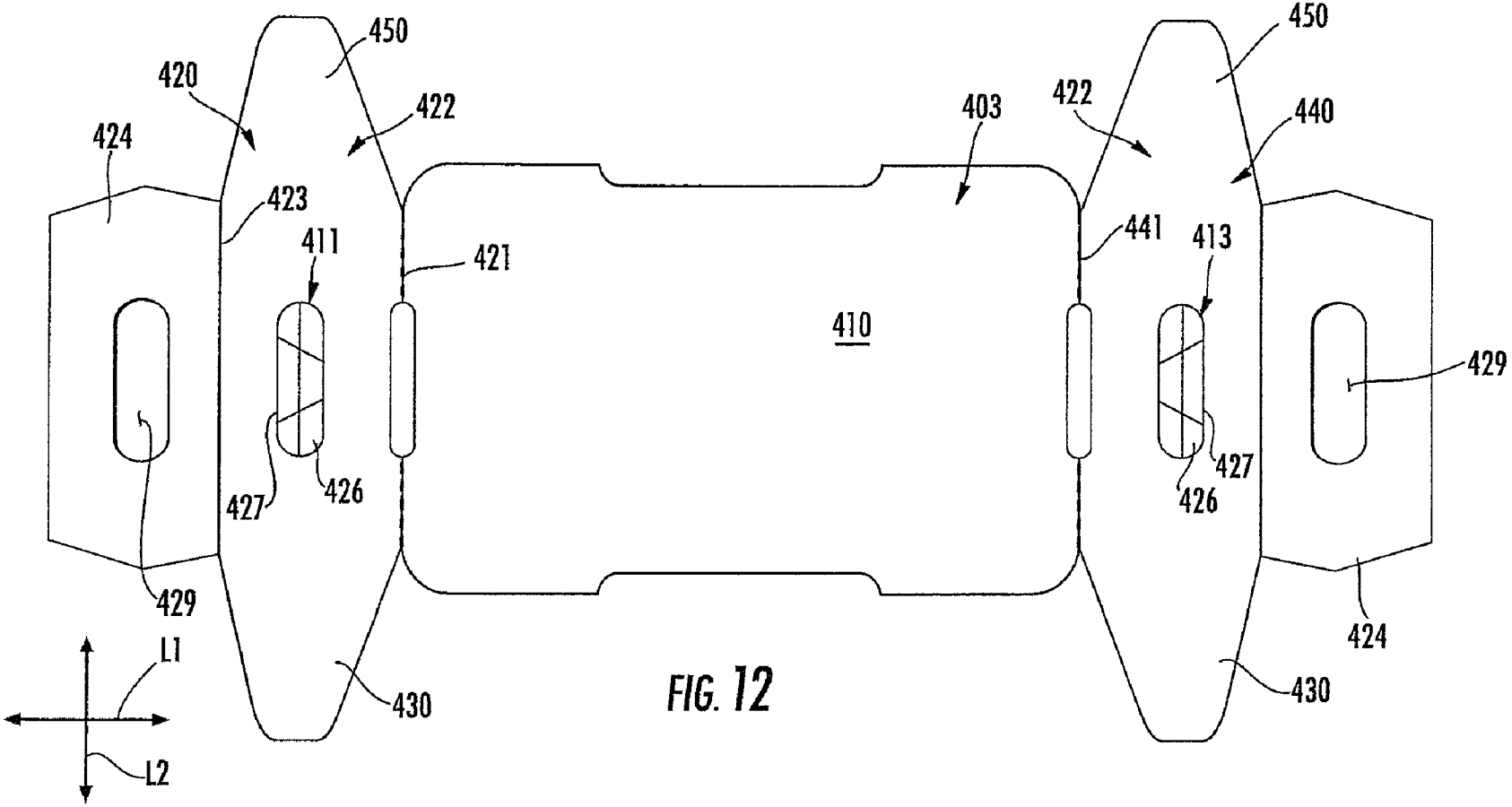
FIGS. 12-13 are various views of a blank and/or carton of a fifth embodiment of the disclosure.
Figure 13:
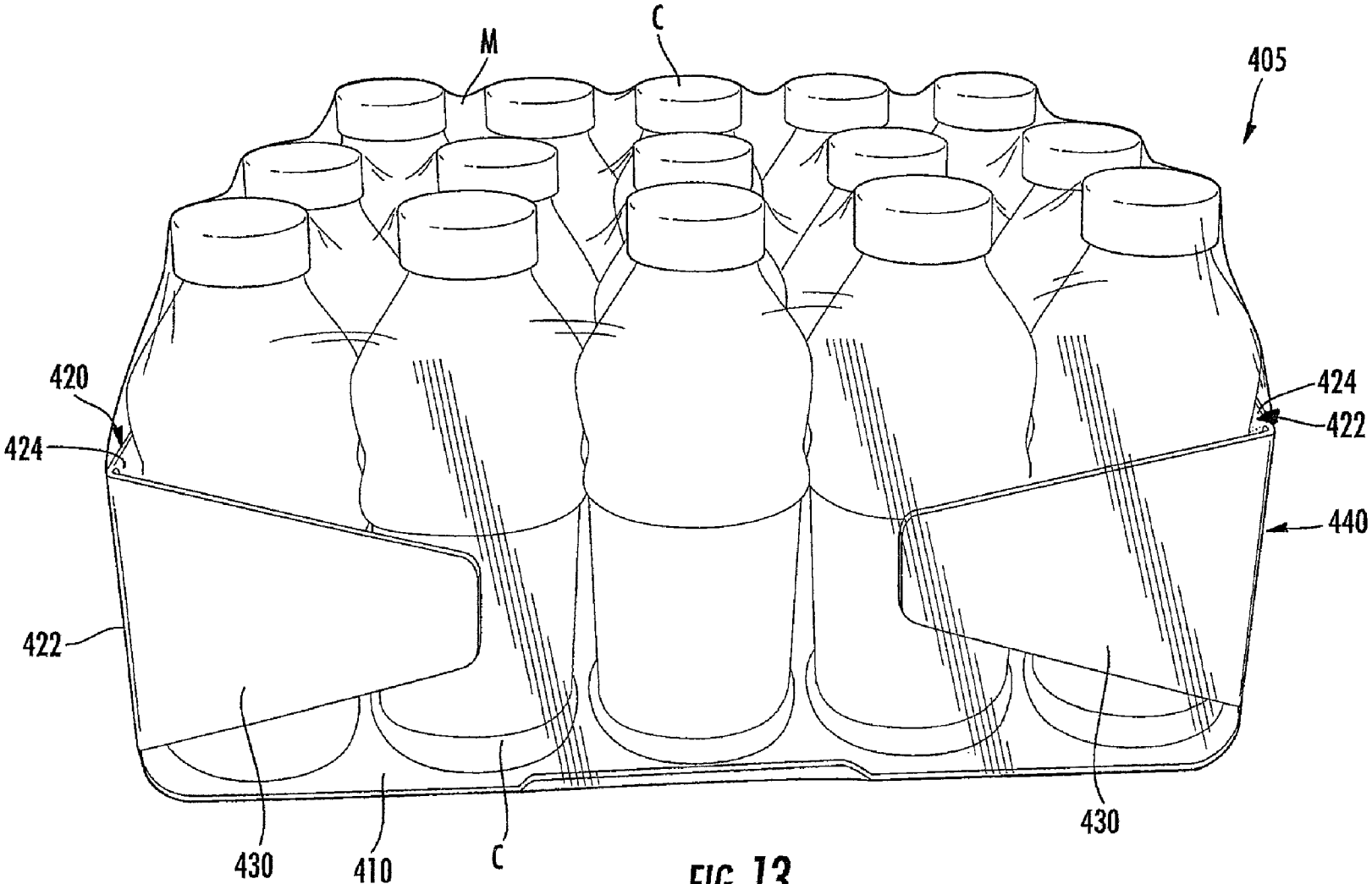

FIG. 12 illustrates a fifth embodiment of a blank 403 used to form a carton 405 (FIG. 13) similar to the previous embodiments that may be secured to containers C by packaging material M. In the embodiment of FIGS. 12 and 13, the blank 403 comprises a central panel 410 foldably connected to a first side panel 420 at a first lateral fold line 421 and a second side panel 440 foldably connected to the central panel 410 at a second lateral fold line 441.

The first side panel 420 is located at a first longitudinal end of the central panel 410 and includes a central portion 422 foldably connected to the central panel and a handle reinforcement flap 424 foldably connected to the central portion at a lateral fold line 423. The central portion 422 includes an elongate handle flap 426 foldably connected to the central portion at a lateral fold line 427. The first side panel 420 has lateral extension 430, 434 that extend laterally outward from the central portion 422 to form protruding lateral edges of the blank 403. The lateral extensions 430, 434 extend outwardly in the lateral direction L2 beyond the edges of the central panel 410. The handle reinforcement flap 424 has an elongate handle opening 429 sized to correspond with the shape of the handle flap 426.

In the embodiment of FIGS. 12-13, the second side panel 440 is located at a second longitudinal end of the central panel 410 and is generally a mirror image of the first side panel 420. Accordingly, like reference numbers have been used to designate similar or identical components or features that comprise the first and second side panels 420, 440. The first and second side panels 420, 440 may be otherwise shaped and arranged without departing from the invention.

In the embodiment of FIGS. 12-13, the first handle 411 is formed in the first side panel 420 and the second handle 413 is formed in the second side panel 440 and has identical components as the first handle. The features that form the first and second handles 411, 413 of the carton include the elongate handle flaps 426 formed in the first panels 422 and the elongate handle openings 429 formed in the second panels 424. The handles 411, 413 may include other features or the illustrated features may be otherwise shaped and/or arranged without departing from the invention.

The blank 403 is formed into the carton by folding the handle reinforcement flaps 424 at lateral fold lines 423 so that respective handle reinforcement flaps are in face-to-face relation with the central portions 422 of the side panels 420, 440. The elongate handle openings 429 in the handle reinforcement flaps 424 are aligned with the elongate handle flaps 426 in the central portions 422. The handle reinforcement flaps 424 can be secured to the central portions 422 by adhesive (e.g., glue). The side panels 420, 440 are upwardly folded relative to the central panel 410 at respective fold lines 421, 441 to form a space for receiving the containers. Containers C are placed on the central panel 410 either before or after the folding of the side panels 420, 440 so that the containers are supported on the central panel 410. The lateral extensions 430 of the side panels 420, 440 can be folded relative to a respective central portion 422 of the side panels to be respectively shaped to curve around a corner of the package and at least partially form the front of the package. The lateral extensions 450 of the side panels 420, 440 can be folded relative to a respective central portion 422 of the side panels to be respectively shaped to curve around a corner of the package and at least partially form the back of the package. The lateral extensions 430, 450 are useful reinforcing the corners of the carton 405 and for providing front and back surfaces for presenting advertising or other information. As with the previous embodiments, the containers C and the carton 405 are secured together by an overwrap of shrink-wrap or other packaging material M. In some embodiments, the lateral extensions 430, 450 may be formed to curve around the corners of the carton 405 as the packaging material M is applied to the carton. The handles 411, 413 can be activated by uncovering the handles from the packing material M, or alternatively, the packaging material can be punctured, pushed and/or folded inward through the handle openings when the handles are activated. Regardless of the positioning of the packaging material M, the handles are further activated by inwardly folding the handle panels 426 into handle openings 429 so that the carton may be grasped and carried by the handles 411, 413.

In alternative embodiments, the first panels 422 can be downwardly folded relative to the central panel 410 and the central panel can be placed on top of the containers C prior to the application of the packaging material M.

In alternative embodiments, the packaging material M can be omitted from any of the embodiments shown herein without departing from the invention. Further, the packaging material can partially or fully enclose the exterior surface of the carton and the containers C held therein to form the package. The various handle panels illustrate herein may have fold lines or other features to facilitate actuation of the handles and grasping of the carton.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments, a fold line can be any substantially linear, although not necessarily straight, form of weakening that facilitates folding therealong. More specifically, but not for the purpose of narrowing the scope of the present invention, fold lines may include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments that are capable of use in various other combinations, modifications, and environments and are capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the invention.

What is claimed is:

1. A carton for cooperating with a packaging material to contain a plurality of articles, the carton comprising:

a plurality of panels comprising a central panel, a first side panel, and a second side panel, the first side panel and the second side panel each being respectively positioned relative to the central panel to at least partially form a space for receiving the articles;

a handle in at least one of the first side panel and the second side panel, the handle is adapted for grasping and carrying the carton;

a reinforcement flap foldably attached to the at least one of the first side panel and the second side panel at a lateral fold line for positioning relative to the at least one of the first side panel and the second side panel for contacting the articles to secure the carton to the articles, the reinforcement flap having at least one opening for at least partially receiving an article of the plurality of articles; and at least one handle reinforcement flap foldably attached to the at least one of the first side panel and the second side panel at a longitudinal fold line, the at least one handle reinforcement flap has a handle opening for cooperating with the handle.

2. The carton of claim 1 wherein the reinforcement flap is for at least partially receiving a respective top portion of the articles.

3. The carton of claim 1 further comprising a front panel foldably attached to the central panel and a back panel foldably attached to the central panel.

4. The carton of claim 1 wherein the central panel has a plurality of openings for at least partially respectively receiving the plurality of articles.

5. The carton of claim 4 wherein the at least one opening of the reinforcement flap is aligned with an opening of the plurality of openings of the central panel.

6. The carton of claim 1 wherein the handle comprises a handle flap that is positionable relative to the at least one of the first side panel and the second side panel.

7. The carton of claim 1 in combination with the articles, wherein the central panel is a bottom panel supporting the articles, and the reinforcement flap forms a top panel of the carton spaced-apart from the bottom panel and attached to a top of the articles.

8. A carton for cooperating with a packaging material to contain a plurality of articles, the carton comprising:

a plurality of panels comprising a central panel, a first side panel, and a second side panel, the first side panel and the second side panel each being respectively positioned relative to the central panel to at least partially form a space for receiving the articles;

a handle in at least one of the first side panel and the second side panel, the handle is adapted for grasping and carrying the carton;

a reinforcement flap foldably attached to the at least one of the first side panel and the second side panel for positioning relative to the at least one of the first side panel and the second side panel for contacting the articles to secure the carton to the articles, the reinforcement flap having at least one opening for at least partially receiving an article of the plurality of articles; and at least one handle reinforcement flap foldably attached to the at least one of the first side panel and the second side panel, the at least one handle reinforcement flap has a handle opening for cooperating with the handle;

wherein the reinforcement flap comprises lateral extensions extending from respective lateral ends of the at least one of the first side panel and the second side panel, the lateral extensions being respectively foldable relative to the at least one of the first side panel and the second side panel.

9. The carton of claim 8 wherein the central panel is a bottom panel for supporting the articles.

10. A carton in combination with a plurality of articles, the carton being for cooperating with a packaging material to contain the plurality of articles, the carton comprising:

a plurality of panels comprising a central panel, a first side panel, and a second side panel, the first side panel and the second side panel each being respectively positioned relative to the central panel to at least partially form a space for receiving the articles;

a handle in at least one of the first side panel and the second side panel, the handle is adapted for grasping and carrying the carton, a reinforcement flap foldably attached to the at least one of the first side panel and the second side panel for positioning relative to the at least one of the first side panel and the second side panel for contacting the articles to secure the carton to the articles, the reinforcement flap having at least one opening for at least partially receiving an article of the plurality of articles; and at least one handle reinforcement flap foldably attached to the at least one of the first side panel and the second side panel, the at least one handle reinforcement flap has a handle opening for cooperating with the handle;

wherein the central panel is a top panel of the carton attached to a top of the articles.

11. A package comprising:

a carton comprising a central panel, a first side panel, a second side panel, a handle in at least one of the first side panel and the second side panel, a reinforcement flap foldably attached to the at least one of the first side panel and the second side panel at a lateral fold line for positioning relative to the at least one of the side panels, at least one handle reinforcement flap foldably attached to the at least one of the first side panel and the second side panel at a longitudinal fold line, the at least one handle reinforcement flap has a handle opening for cooperating with the handle, the handle is adapted for grasping and carrying of the package and the side panels are positioned relative to the central panel to form a space;

a plurality of articles at least partially positioned in the space and contained in the carton; and a packaging material applied to the carton and the articles to attach the carton to the articles, the reinforcement flap comprises at least one opening for at least partially receiving an article of the plurality of articles to secure the articles to the carton.

12. The package of claim 11 wherein the central panel is a bottom panel supporting the articles.

13. The package of claim 11 further comprising a front panel foldably attached to the central panel and a back panel foldably attached to the central panel.

14. The package of claim 11 wherein the handle comprises a handle flap foldably attached to the at least one side panel.

15. A blank for forming a carton for containing a plurality of articles in cooperation with a packaging material, the blank comprising:

a plurality of panels comprising a central panel, a first side panel, and a second side panel, the first side panel and the second side panel are for being positioned relative to the central panel to at least partially form a space for receiving the articles when the carton is formed from the blank;

handle features in at least one of the first side panel and the second side panel, the handle features comprising a handle adapted for grasping and carrying the carton formed from the blank;

a reinforcement flap foldably attached to the at least one of the first side panel and the second side panel at a lateral fold line for positioning relative to the at least one of the first side panel and the second side panel and for contacting the articles to secure the carton to the articles when the carton is formed from the blank, the reinforcement flap having at least one opening for at least partially receiving an article of the plurality of articles when the blank is formed into the carton; and the handle features comprise at least one handle reinforcement flap foldably attached to the at least one of the first side panel and the second side panel at a longitudinal fold line, the at least one handle reinforcement flap has a handle opening for cooperating with the handle.

16. The blank of claim 15 further comprising a front panel foldably attached to the central panel and a back panel foldably attached to the central panel.

17. The blank of claim 15 wherein the central panel has a plurality of openings for at least partially respectively receiving the plurality of articles when the blank is formed into the carton.

18. The blank of claim 15 wherein the handle comprises a handle flap foldably attached to the at least one side panel.

19. A method of forming a package, the method comprising:

providing a carton comprising a central panel, a first side panel, a second side panel, and a handle in at least one of the first side panel and the second side panel, and a reinforcement flap foldably attached to the at least one of the first side panel and the second side panel at a lateral fold line, the reinforcement flap having at least one opening, at least one handle reinforcement flap foldably attached to the at least one of the first side panel and the second side panel at a longitudinal fold line, the at least one handle reinforcement flap has a handle opening for cooperating with the handle, the handle is adapted for grasping and carrying of the package;

positioning a plurality of articles relative to the carton;

positioning the carton relative to the articles so that the plurality of articles are at least partially contained in the carton, the positioning the carton comprises positioning the reinforcement flap to contact the articles so that at least one of the articles is received in the at least one opening; and applying a packaging material to the carton and the articles to at least partially attach the carton to the plurality of articles.

20. The method of claim 19 further comprising positioning the at least one side panel relative to the articles to position the handle for grasping and carrying of the package.

21. The method of claim 19 wherein the positioning of the carton comprises placing the at least one handle reinforcement flap in face-to-face contact with the at least one of the first side panel and the second side panel.

22. The method of claim 21 wherein the handle comprises at least one handle flap in the at least one of the first side panel and the second side panel, the method further comprising forming the handle for grasping of the package by inserting the at least one handle flap into the handle opening.

23. The method of claim 19 wherein the positioning of the carton comprises placing the reinforcement flap in a spaced-apart relationship from the central panel.

24. The method of claim 23 further comprising placing the reinforcement flap over tops of the articles to at least partially contain the articles in the container.

* * * * *